US007204583B2

(12) United States Patent
Lean et al.

(10) Patent No.: US 7,204,583 B2
(45) Date of Patent: Apr. 17, 2007

(54) CONTROL ELECTRODE FOR RAPID INITIATION AND TERMINATION OF PARTICLE FLOW

(75) Inventors: Meng H. Lean, Santa Clara, CA (US); John J. Ricciardelli, Poughkeepsie, NY (US); Osman T. Polatkan, N. Haledon, NJ (US); Michael J. Savino, Tappan, NY (US)

(73) Assignee: Xerox Corporation, Stamford, CT (US)

( * ) Notice: Subject to any disclaimer, the term of this patent is extended or adjusted under 35 U.S.C. 154(b) by 301 days.

(21) Appl. No.: 10/960,593

(22) Filed: Oct. 7, 2004

(65) Prior Publication Data

US 2006/0077230 A1 Apr. 13, 2006

(51) Int. Cl.
*B41J 2/04* (2006.01)

(52) U.S. Cl. ..... 347/54; 347/55

(58) Field of Classification Search ..... 347/20, 347/21, 40, 42, 44, 47, 54, 56, 55, 46
See application file for complete search history.

(56) References Cited

U.S. PATENT DOCUMENTS

| | | | | |
|---|---|---|---|---|
| 4,896,174 | A | 1/1990 | Stearns | 347/120 |
| 5,893,015 | A | 4/1999 | Mojarradi et al. | 399/291 |
| 6,116,718 | A | 9/2000 | Peeters et al. | 347/21 |
| 6,134,412 | A | 10/2000 | Thompson | 399/266 |
| 6,137,979 | A | 10/2000 | Gartstein et al. | 399/266 |
| 6,219,515 | B1 | 4/2001 | Lestrange | 399/289 |
| 6,246,855 | B1 | 6/2001 | Gartstein et al. | 399/281 |
| 6,272,296 | B1 | 8/2001 | Gartstein | 399/55 |
| 6,290,342 | B1 | 9/2001 | Vo et al. | 347/55 |
| 6,293,659 | B1 | 9/2001 | Floyd et al. | 347/85 |
| 6,328,409 | B1 | 12/2001 | Peeters et al. | 347/21 |
| 6,340,216 | B1 * | 1/2002 | Peeters et al. | 347/21 |
| 6,351,623 | B1 | 2/2002 | Thayer et al. | 399/258 |
| 6,416,158 | B1 | 7/2002 | Floyd et al. | 347/21 |
| 6,416,159 | B1 | 7/2002 | Floyd et al. | 347/21 |
| 6,439,711 | B1 | 8/2002 | Carlini et al. | 347/100 |
| 6,454,384 | B1 | 9/2002 | Peeters et al. | 347/21 |
| 6,467,862 | B1 | 10/2002 | Peeters et al. | 347/7 |
| 6,467,871 | B1 | 10/2002 | Moffat et al. | 347/21 |
| 6,499,831 | B2 | 12/2002 | Schmidlin | 347/55 |
| 6,511,149 | B1 | 1/2003 | Lean et al. | 347/21 |
| 6,521,297 | B2 | 2/2003 | McDougall et al. | 347/20 |
| 6,523,928 | B2 | 2/2003 | Peeters et al. | 347/21 |
| 6,598,954 | B1 | 7/2003 | Moffat et al. | 347/21 |
| 6,719,399 | B2 | 4/2004 | McDougall et al. | 347/21 |
| 6,751,865 | B1 | 6/2004 | Peeters et al. | 347/21 |

* cited by examiner

*Primary Examiner*—Juanita D. Stephens
(74) *Attorney, Agent, or Firm*—Fay Sharpe LLP

(57) ABSTRACT

An electrostatic gating assembly utilizing at least three electrodes is disclosed. The assembly is particularly well suited for controlled administration of small particles.

6 Claims, 11 Drawing Sheets

CONTROL ELECTRODE FOR RAPID INITIATION AND TERMINATION OF PARTICLE FLOW

BACKGROUND

The present exemplary embodiment relates to an electrode assembly for controlling particle flow. It finds particular application in conjunction with the printing arts, and will be described with particular reference thereto. However, it is to be appreciated that the present exemplary embodiment is also amenable to other like applications such as pharmaceutical processing of powdered medication.

BRIEF DESCRIPTION

In accordance with one aspect of the present exemplary embodiment, a system for selectively controlling particle flow is provided. The system comprises a passage adapted for housing the flow of a gas therethrough. The passage defines an inlet and an outlet. The system also comprises a particle container and a branch conduit providing communication between the passage and the particle container. The branch conduit provides communication with the passage at a location between the inlet and the outlet. The system also comprises a gating assembly defining an aperture and disposed in the branch conduit. The gating assembly includes an inlet electrode, an exit electrode, and a control electrode. Each electrode is adapted to emit an electric field.

In accordance with another aspect of the present exemplary embodiment, a method for controlling particle flow from a particle source to a flowing medium is provided. The method is performed in a system comprising a passage adapted for housing a flowing medium, a particle source, and a conduit providing communication between the passage and the particle source. As a result of the flowing medium in the passage, particles from the particle source are drawn toward the flowing medium. The method comprises providing an electrode assembly of at least three electrodes in the system such that particles flowing from the particle source to the passage, flow past and in close proximity to the electrode assembly. The method also comprises applying a multi-phase voltage waveform to the electrode assembly to selectively control particle flow from the particle source to the passage.

DETAILED DESCRIPTION

Figure 1:
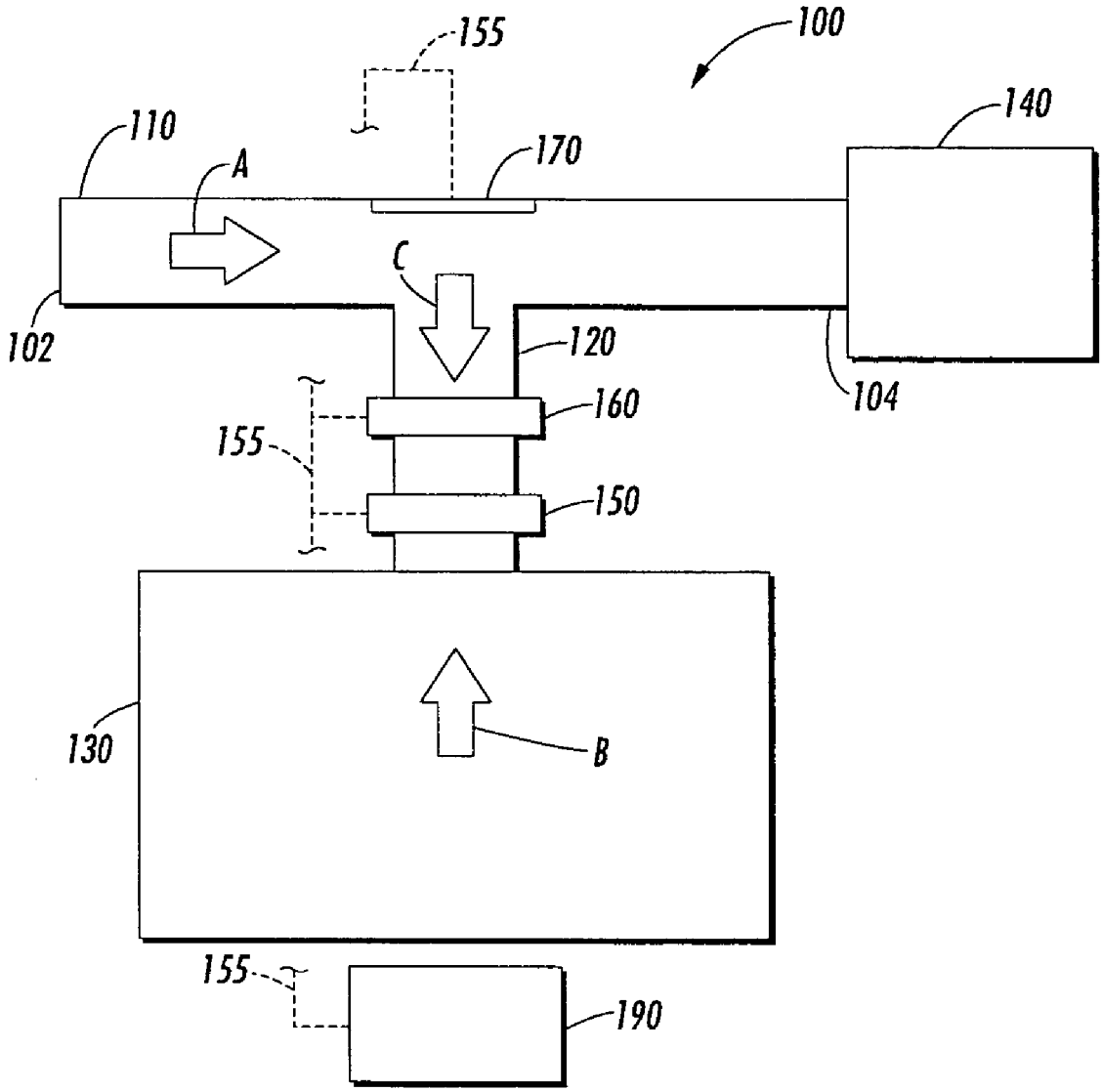
FIG. 1 is a schematic view of an exemplary embodiment system.

The exemplary embodiment relates to an electrode assembly comprising at least three electrodes. Specifically, a third electrode with a switchable control voltage is utilized to augment an on-demand 2 phase electrostatic gating assembly. The gating assembly is particularly adapted for controlling flow of toner in a ballistic aerosol marking (BAM) printer. Use of the exemplary embodiment gating assembly can speed up transient response to On/Off switching, and is especially useful at high writing frequencies. Extending from a binary implementation, the exemplary embodiment gating assembly may also be used for graduated increase or decrease of toner flow by providing the necessary electric field assist or electric field reversal. This capability lends itself to gray level control. The exemplary embodiment is also applicable to the processing of fine particulates such as those in drug delivery systems.

Until recently, powder ballistic aerosol marking (BAM) was a technology being developed for high-speed (60–120 ppm) direct marking. BAM printing has the potential for xerographic quality image robustness. Some notable advances include the design of re-circulating toner supply systems, high-speed drilling of sub-50 um apertures, and on demand 2 phase electrostatic gating of 6 um EA toner through 50 um apertures. Particle electrodynamics of collisional toner motion has been simulated in three-dimensions and shown to compare favorably with lab experimentation. Simulation has also contributed to increased understanding, which has driven the ensuing knowledge-based design for device optimization. The exemplary embodiment gating assembly enables optimal toner gating. Details and information relating to ballistic aerosol marking systems, components, and processes are described in the following U.S. Pat. Nos. 6,751,865; 6,719,399; 6,598,954; 6,523,928; 6,521,297; 6,511,149; 6,467,871; 6,467,862; 6,454,384; 6,439,711; 6,416,159; 6,416,158; 6,340,216; 6,328,409; 6,293,659; and 6,116,718; all of which are hereby incorporated by reference.

The exemplary embodiment gating assembly utilizes 2 phase gating and is more efficient than other gating configurations based upon 3 phase or 4 phase systems. The reason for the increased efficiency is that the aspect ratio of aperture height to aperture width becomes smaller and therefore makes it easier for toner or other particles to pass through the small but shorter aperture. This reduction to 2 phase gating significantly simplifies fabrication and eventual reduction to practice. For 50 um apertures, only very low agglomeration or "fluffy" 6 um toner can be squeezed through the aperture. Modeling has shown that this is indeed possible. This has subsequently been verified experimentally using a Minco grid for traveling wave transport of the toner with 90 degree coupling to the aperture. The aperture is fabricated from an Au coated 2 mil Kapton film with a laser-drilled 50 um hole. A 4 phase circuit is used to drive the traveling wave to transport the toner. The fluidized toner is gated through a 2 phase aperture by electrostatic forces. Toner is gated using two sequential phases of the 4 phase used for transport. Cyan EA toner gated from the supply below is deposited on the upper exit electrode surface around the 50 um aperture.

It should be noted that planar toner transport requires a minimum of 3 phase excitation to provide directionality to cloud motion. Any of the voltage combinations will transport any of the toner polarity combinations equally well for the same E field levels. The fundamental mechanism is that positive toner is pushed in front of a positive pulse while negative toner is pulled behind the positive pulse and vice versa. The difference introduced by aperture gating is the asymmetry due to the geometry. For example, a positive entrance electrode voltage acts to repel positive toner while loading the aperture with negative toner. This action affects the next half-cycle as less positive toner is now available in the vicinity for gating.

FIG. 1 illustrates an exemplary embodiment system 100 comprising a flow passage 110 having an entrance 102 and an exit 104. The system also comprises a branching conduit 120 providing flow communication between the passage 110 and a toner or particle container 130. The flow passage 110 directs a flow of gases indicated by arrow A to a component 140 such as a print head. Disposed within the branching conduit 120 are a pair of apertured electrodes 150 and 160. Electrode 160 is sometimes referred to herein as an exit electrode. Electrode 150 is sometimes referred to herein as an entrance electrode. A third electrode 170 is disposed in the passage 110, generally proximity to the entrance of conduit 120 from the passage 110, and/or in proximity to the exit electrode 160. Electrodes 150, 160, and 170 are described in greater detail herein and constitute or form part of an exemplary embodiment gating assembly. Generally, upon flow of a medium such as gas in the passage 110, shown as arrow A, particles from the container 130 are drawn into that flow and thus entrained within it. Flow of particles in this manner are in the direction of arrow B and in a direction opposite to flow C, described in greater detail herein. The system 100 also comprises a controller 190 which generally powers and/or controls the operation of the electrodes 150, 160, and 170 by a power and/or signal line 155.

The gating electrodes such as electrodes 150 and 160 in FIG. 1 are generally included in a gating assembly that defines an aperture through which the flow of particles is governed or controlled. The gating assembly generally defines an aperture between the two electrodes which are annular in shape. One electrode is positioned upstream of the aperture and the other is positioned downstream. A third control electrode such as electrode 170 is used in conjunction with electrode 150, 160 to control the flow of particulates. The exemplary embodiment is in no way limited to this arrangement however. The size or span of the aperture, i.e. the size of the opening, depends upon the particular application and characteristics of the particles and flowing medium. However, the exemplary embodiment generally includes apertures having a diameter of from about 25 μm to about 75 μm, with 50 μm being typical. The exemplary embodiment includes apertures with significantly larger openings, such as for example, greater than 75 μm, greater than 150 μm, greater than 250 μm, and greater than 500 μm.

Figure 2A:
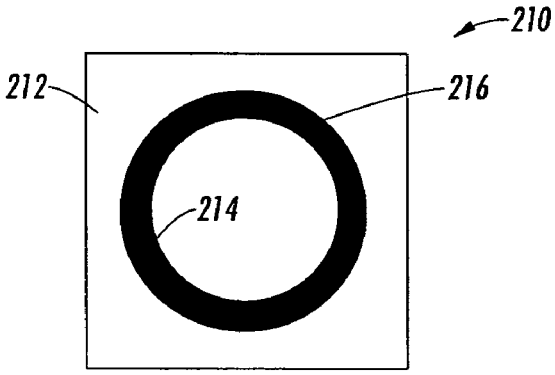
FIG. 2A is a top view of a portion of another exemplary embodiment system.
Figure 2B:
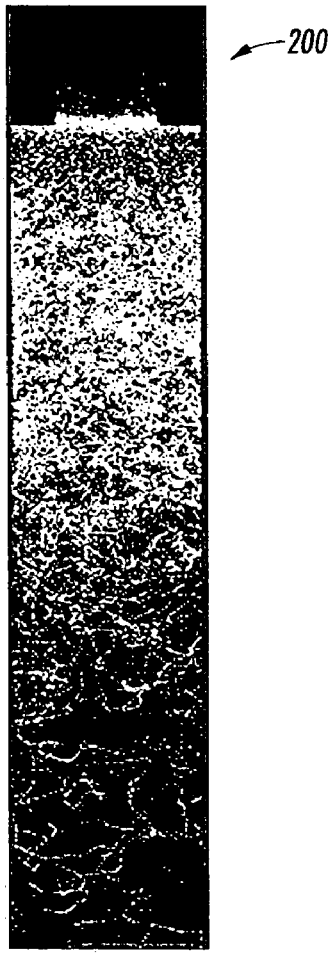
FIG. 2B is a side view of particles dispersed in the system of FIG. 2A.
Figure 2D:
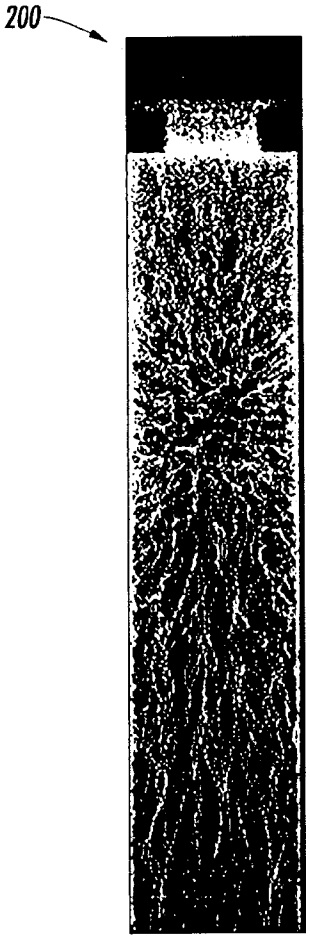
FIG. 2D is a side view illustrating a particle cloud in the system of FIG. 2A.
Figure 2C:
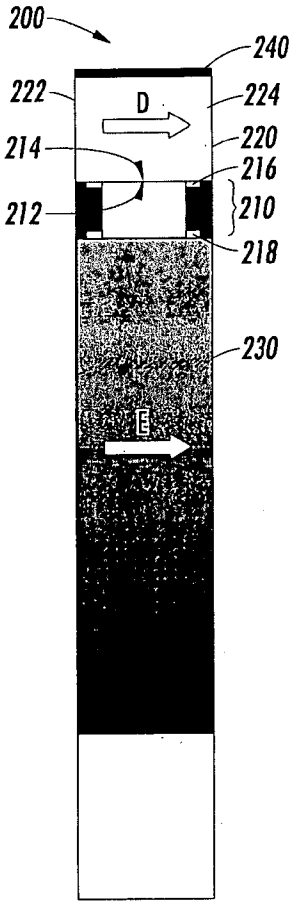
FIG. 2C is a side schematic view of the system of FIG. 2A.

FIGS. 2A–2D illustrate a system using an exemplary embodiment gating assembly. FIG. 2C details the geometry of a cross-section where toner is gated upwards through an aperture into a gas channel for entrainment and eventual deposition onto a print medium. Two annular rings located at the entrance and exit of the aperture are used as gating electrodes. A finite layer of toner with a prescribed volume density is located at a specified distance from the aperture, and moves with a traveling wave velocity to the gating assembly. Traveling wave grids, their use, and manufacture are generally described in U.S. Pat. Nos. 6,351,623; 6,290,342; 6,272,296; 6,246,855; 6,219,515; 6,137,979; 6,134,412; 5,893,015; and 4,896,174, all of which are hereby incorporated by reference. For any given density, a finite number corresponding to the cell dimension are randomly seeded within the toner cloud.

Gated toner is continually replenished to maintain constant cloud density. Specifically, FIG. 2C illustrates a system 200 comprising an exemplary embodiment gating assembly 210. The assembly 210 is shown in FIG. 2A. The system comprises the assembly 210 which is in proximity to a flowing gas channel 220 and a source of particles or toner 230. The channel 220 extends between an inlet 222 and an exit 224 and is adapted to receive a flow of gas, designated by arrow D, generally under relatively high pressure, such as from about 10 to about 70 atmospheres for example. The toner source 230 is generally in the form of a container or reservoir adapted for housing toner and a cloud of toner that can be transported to the gating assembly 210. Such transportation, designated by arrow E, can be performed by one or more traveling wave grids. The gating assembly 210 defines a member 212 that defines an aperture 214 extending through the member 212 and which provides communication between the channel 220 and the source of toner 230. The gating assembly also comprises a first electrode 216 and a second electrode 218, spaced from the first electrode 216. It can be seen that the first electrode 216 is disposed proximate one face or end of the assembly 210, and the second electrode 218 is disposed proximate the other face, opposite from the first. FIG. 2A is a top view of the gating assembly and illustrates the first electrode 216 and aperture 214, defined therein, the electrode being disposed in the member 212. The gating assembly 210 also comprises a control electrode 240, as shown in FIG. 2C. Electrode 240 is described in greater detail herein. FIG. 2B illustrates a tracer plot of bipolar toner motion. FIG. 2D shows the corresponding tracer plot for unipolar toner. Unipolar toner suffers mutual repulsion leading to rapid cloud expansion. In a bias field, the cloud also drifts toward the electrode of the opposite polarity.

Figure 3:
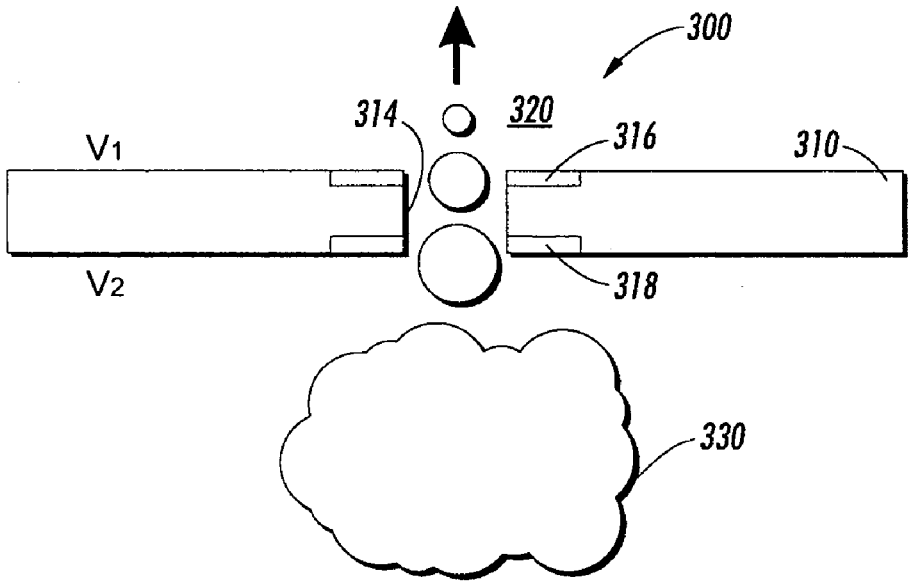
FIG. 3 is another exemplary embodiment system.
Figure 4:
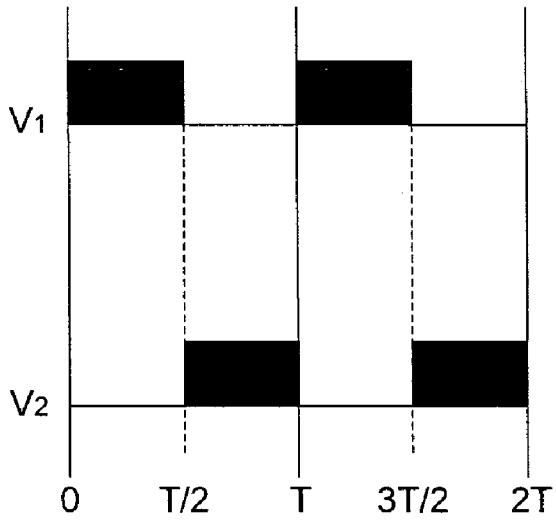
FIG. 4 is a waveform used in the exemplary embodiment systems.

FIG. 3 is a schematic of another system using the exemplary embodiment gating assembly with the switching voltage waveforms in FIG. 4. Specifically, FIG. 3 illustrates a system 300 comprising a gating assembly 310 which provides communication between a cloud of toner or other particles 330 and a chamber or other region 320 on an opposite side of the gating assembly 310. The gating assembly 310 includes a first electrode 316 and a second electrode 318 that define an aperture 314 extending between opposite faces of the assembly 310. The electrodes 316 and 318 are electrically biased to voltages $V_1$ and $V_2$, respectively. The gating assembly 310 also includes at least a third control electrode (not shown). As explained in greater detail herein, the electrodes and particular application of voltages applied thereto induce transport of particles or toner from the cloud 330 through the aperture 314 of the gating assembly 310 to region 320. FIG. 4 is a representative voltage waveform showing application of voltages $V_1$ and $V_2$ over time. The resulting pattern is a 2 phase, 50% duty cycle.

The gating of toner at high frequencies, or writing speeds, requires faster rise times and shorter decay times in order to meet the precise toner metering requirements. The present exemplary embodiment gating assembly specifically utilizes a third electrode to introduce an axial E field to address this requirement. Both operating configurations are simulated using parameters listed in Table 1, below.

TABLE 1

Toner Flow Rates for Range of Exit Electrode Voltages

| Parameter | Description | Nominal Value |
|---|---|---|
| r | Toner radius <um> | 2.9 |
| m | Toner mass <gm> | $8.2852 \times 10^{-11}$ |
| $V_{toner}$ | Toner volume <mm$^3$> | $1.0216 \times 10^{-7}$ |
| q | Toner charge <C> | $3.07 \times 10^{-15}$ |

TABLE 1-continued

Toner Flow Rates for Range of Exit Electrode Voltages

| Parameter | Description | Nominal Value |
|---|---|---|
| ρm | Material density <gm/cm$^3$> | 0.811 |
| q/m | Charge/mass ratio <μC/gm> | 37.0540 |
| q/d | Charge/diameter ratio <μC/cm> | $5.2931 \times 10^{-6}$ |
| n | Initial toner supply <#/cell volume> | 400 |
| $V_{gate}$ | Gating Voltage <V> | 400 |
| Δt | Time-step <s> | 5.0 μs |
| $f_{gate}$ | Gating frequency <Hz> | 1000 |
| nV | Volume density <%> | 1.8854 |
| ng | Gating rate <#/s> | 600,000 |
| $n_g m$ | Gated mass per second <μg/s> | 49.7112 |
| $dn_g/dV$ | Gated toner per Volt.second | 1500 |
| h | Pixel size <um> @300 spi (w = h) | 85 |
| $v_{media}$ | Print media velocity <cm/s> | 2.54 |
| pma | Printed mass/area @$v_{media}$ <mg/cm$^2$> | 2.3160 |
| t | Thickness of printed toner @$v_{media}$ <um> | 28.5573 |

Figure 5:
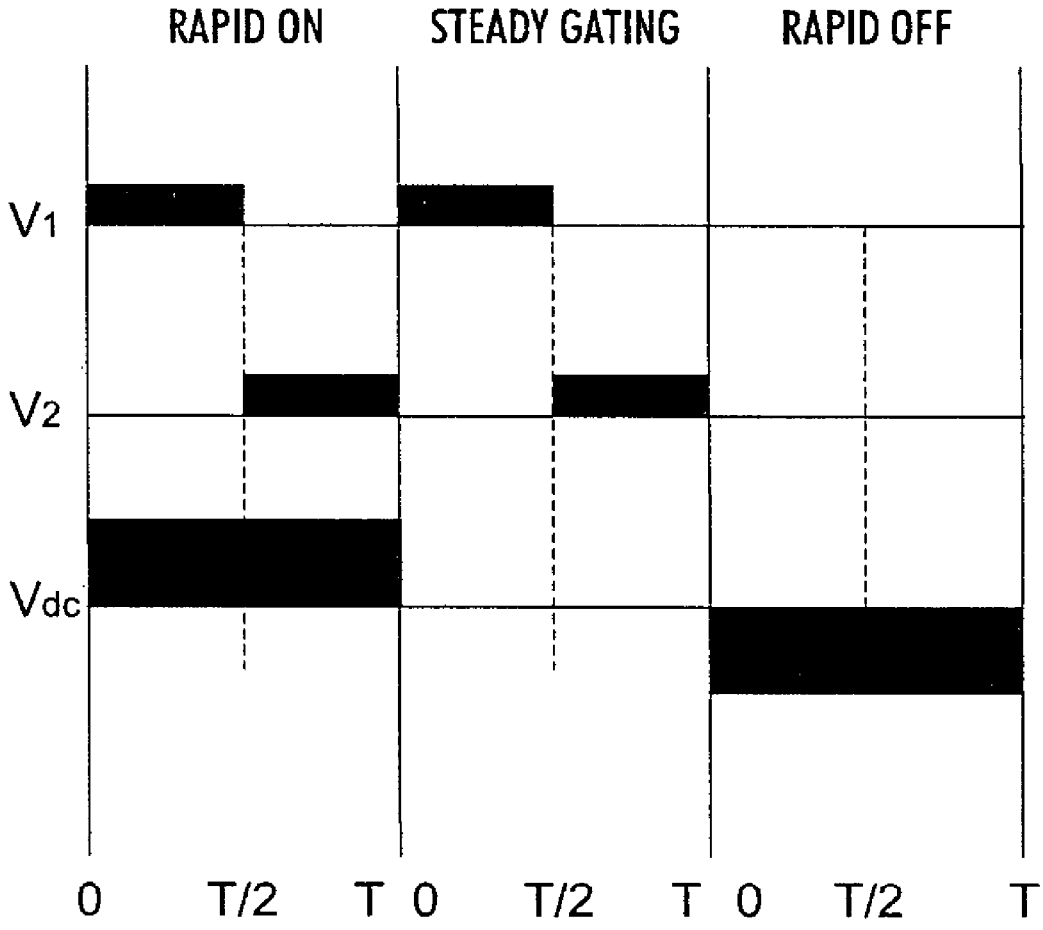
FIG. 5 is another waveform used in the exemplary embodiment systems.

A third electrode is represented for example as 170 in FIG. 1 and 240 in FIG. 2C. The third electrode can be located at the roof of the channel. The third electrode is generally located near the exit electrode such that the exit electrode is between the control electrode and the inlet electrode. The purpose of the control electrode is to provide an additional field assist or field reversal along the aperture axis. Field assist refers to enhancement of the E field and so improvement in the flow of toner for faster turn ON. Field reversal means that the E field retards the flow of toner for rapid shut OFF. The implementation generally utilizes the voltage patterns shown in FIG. 5. For faster turn ON of negative toner flow, the third electrode denoted as $V_{dc}$, is set to +1 kV for several cycles. The 2 phase gating voltages are positive to maximize throughput. For sustained toner flow, $V_{dc}$ is set to zero. Finally, for rapid shut OFF, $V_{dc}$ is set to −1 kV for several cycles while the gating voltages are set to zero.

Figure 6:
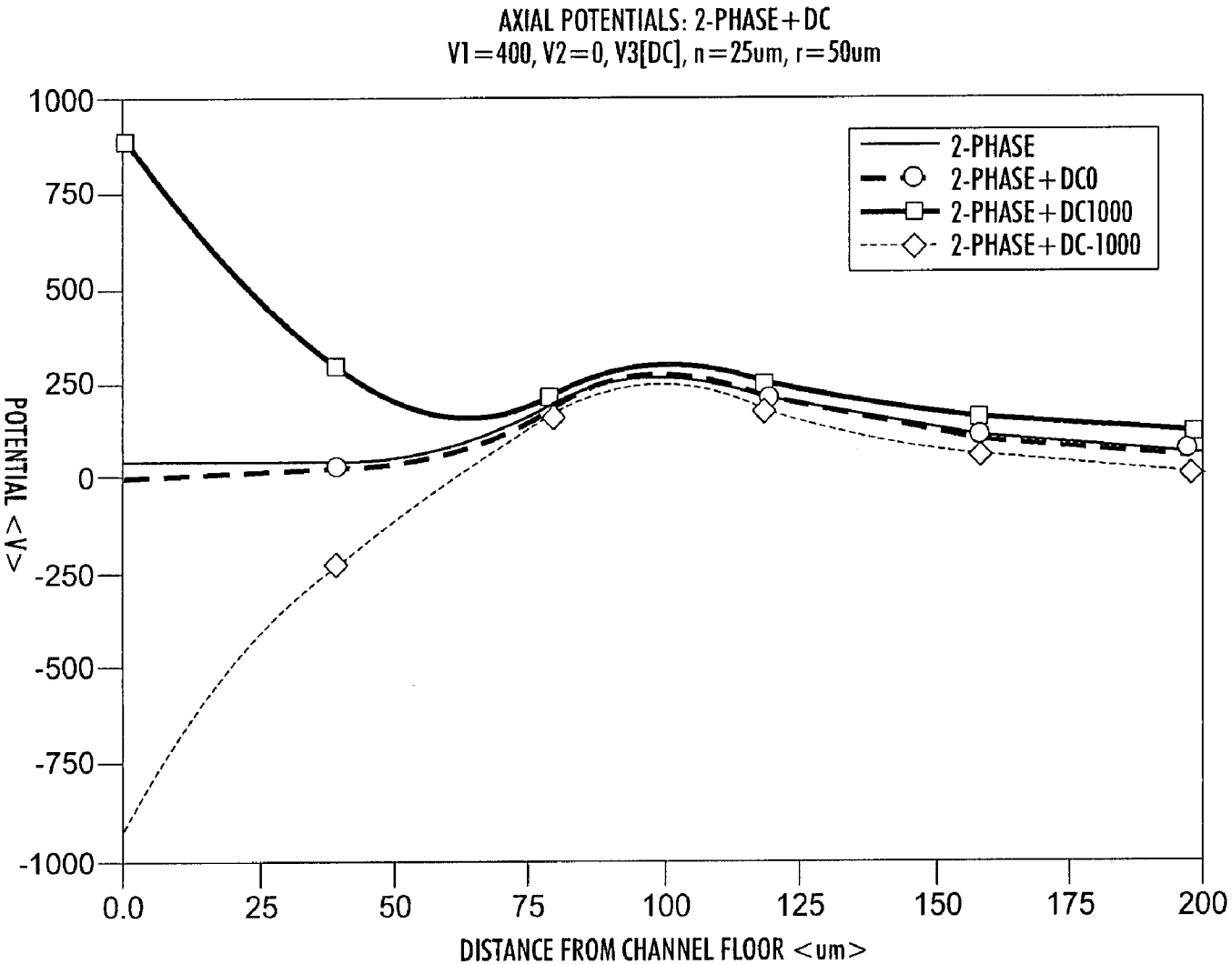
FIG. 6 is a graph illustrating axial potentials as a function of distance from the channel floor.
Figure 7:
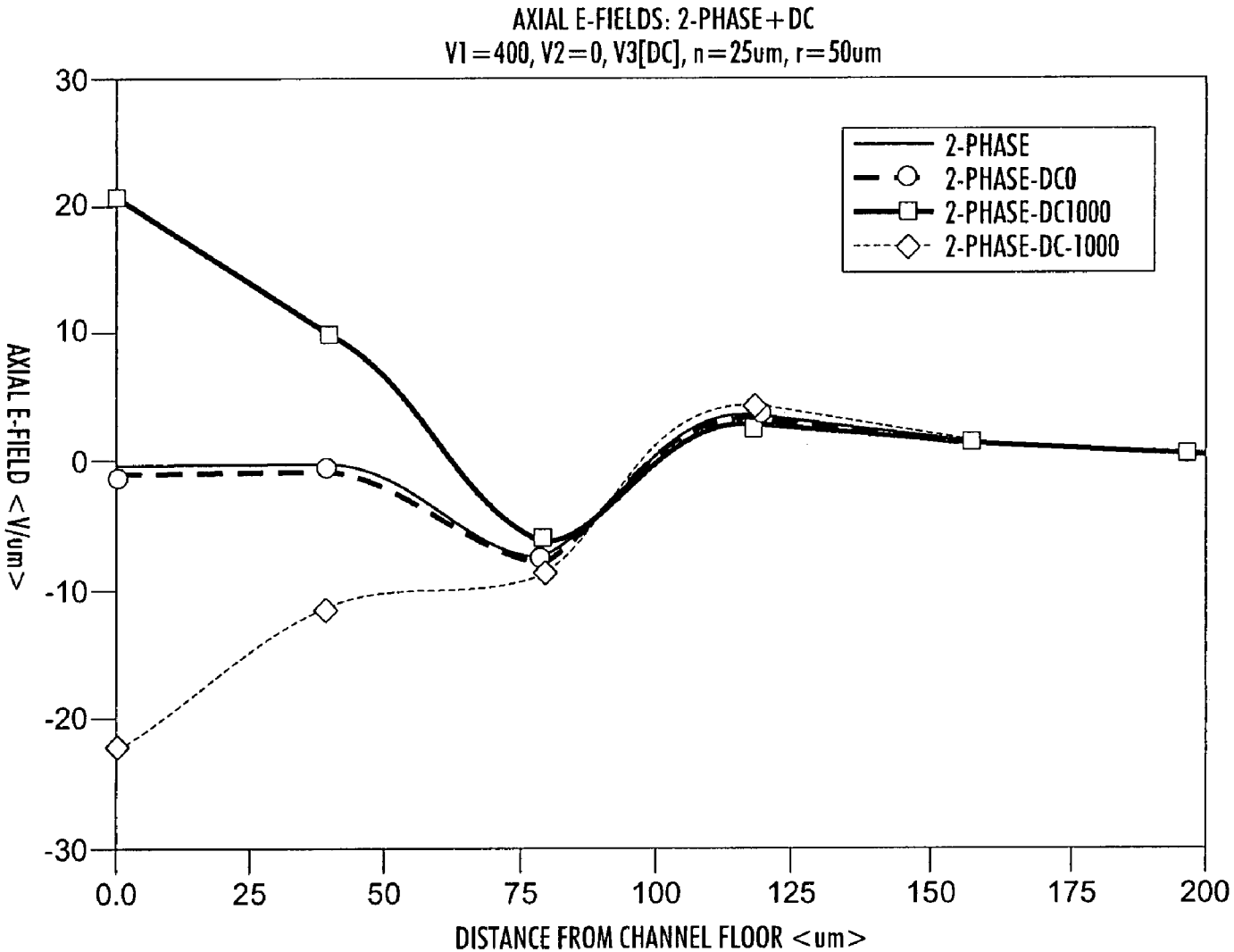
FIG. 7 is a graph of axial E fields as a function of distance from the channel floor.
Figure 8:
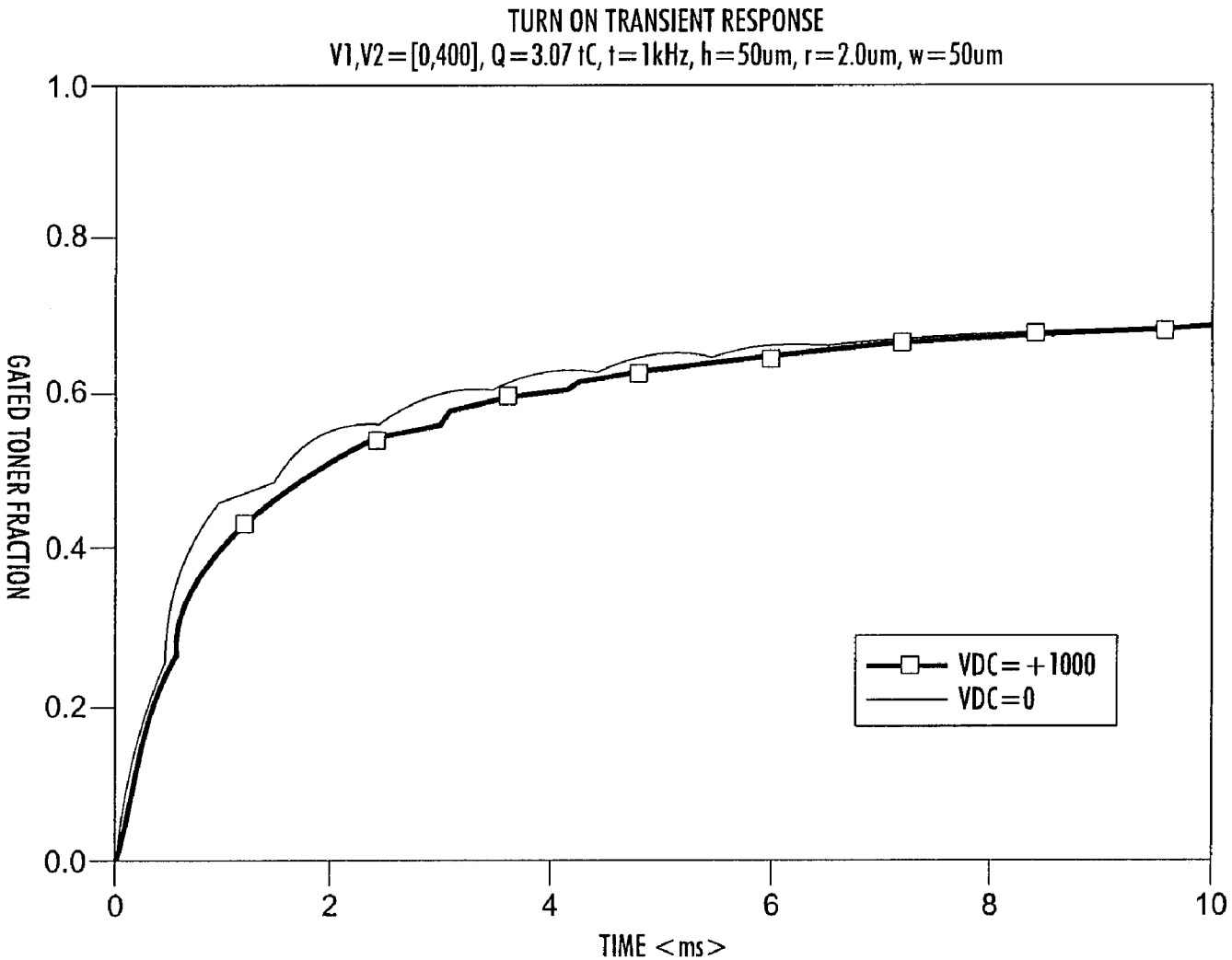
FIG. 8 is a graph of transient response as a function of time.
Figure 9:
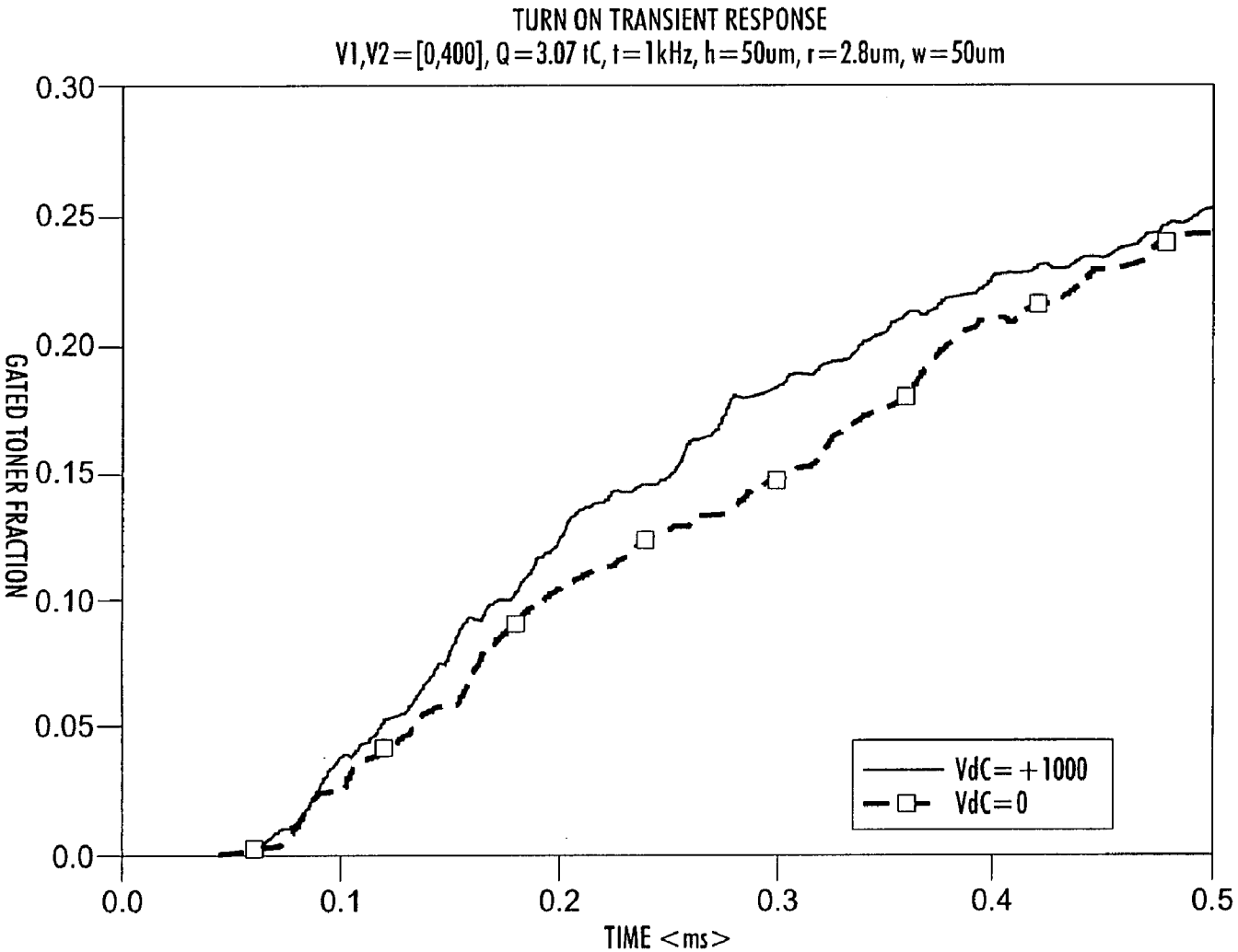
FIG. 9 is a graph of transient response as a function of time.

FIG. 6 shows the axial potential for the exemplary embodiments described herein. The horizontal axis measures the distance from the roof of the channel back through the aperture into the toner cavity. The first 65 μm is the channel height, the next 35 μm is the Kapton film and two electrodes. The toner cavity begins at 100 μm and extends for a thickness of 300 μm. The respective axial E field components shown in FIG. 7 clearly illustrate the designed field assist and field reversal capabilities of this configuration. FIG. 8 shows the transient response of the aperture to a turn ON signal. Gating frequencies can go as high as 20 kHz. In this instance, a typical frequency used is 1 kHz. As can be seen, the time constant is in milliseconds. The field assist acts to increase volume flow and reduce rise time constant. A clearer picture is shown in FIG. 9 by a magnified view of the first 0.5 ms corresponding to the first half-cycle.

Figure 10:
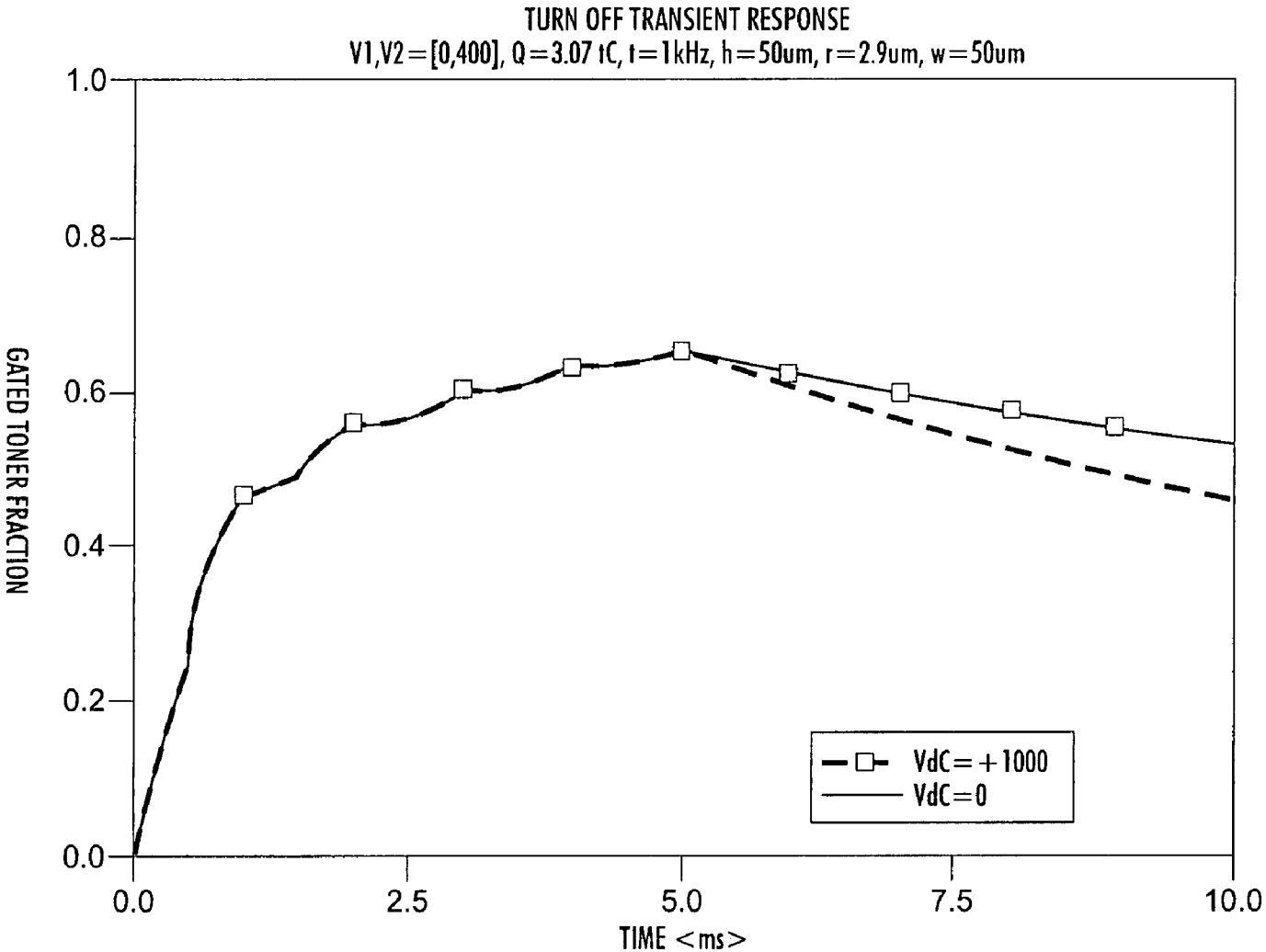
FIG. 10 is a graph of transient turn off response as a function of time.
Figure 11:
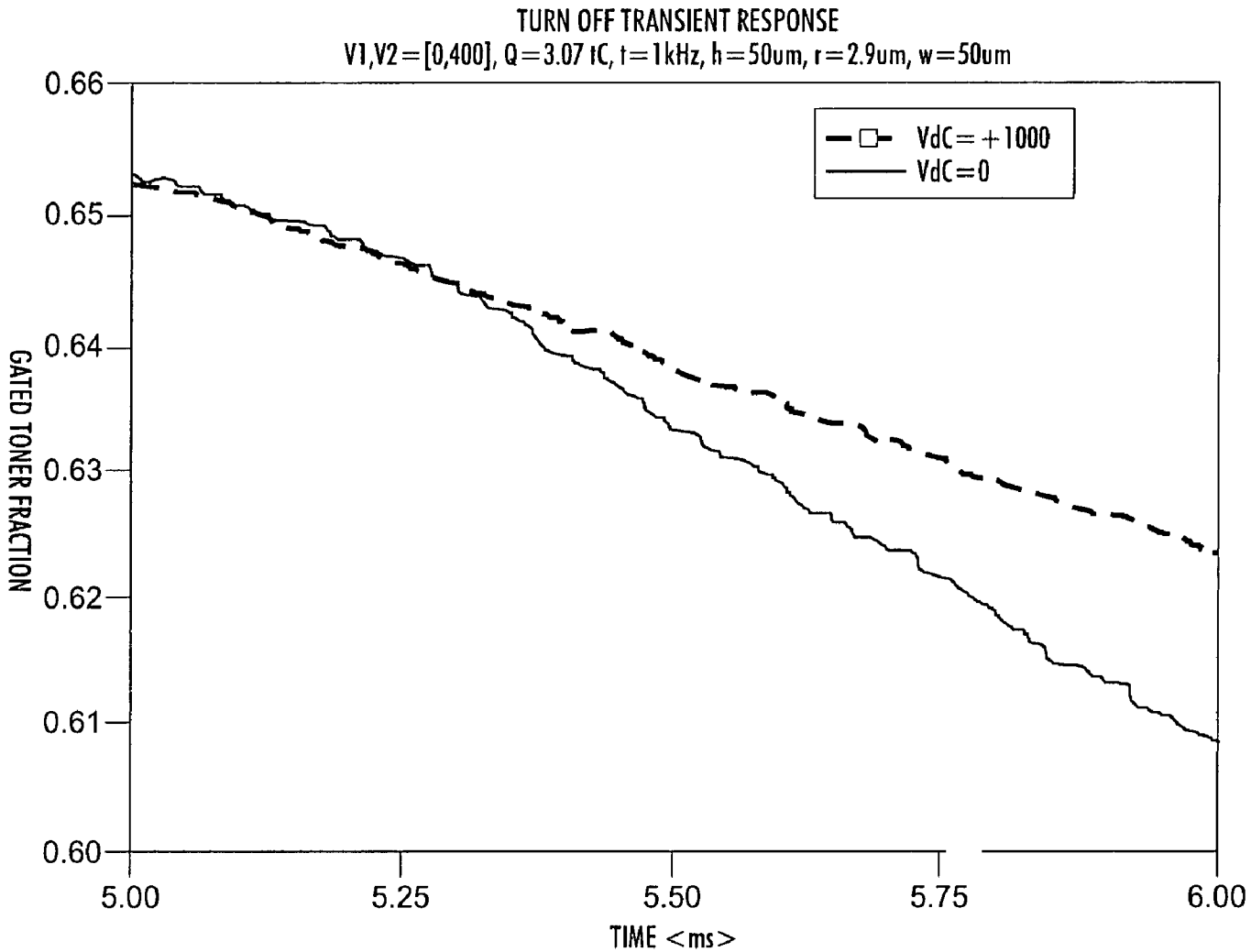
FIG. 11 is a graph of transient turn off response as a function of time.

The shut OFF case is even more dramatic due to the higher axial E fields. FIG. 10 shows a situation where toner is gated for 5 ms before shut OFF is activated. Since the rise time constant is about 1 ms, the On duration allows the gating to achieve somewhat steady-state flow. The two curves compare the difference in the gated toner fractions with and without the control electrode. The reverse field due to the control electrode rapidly stops toner flow. FIG. 11 shows the magnified view of the cycle immediately after the reverse field is applied. As can be seen, the decay time constant is much smaller with the field reversal.

Although the various multi-electrode gating assemblies described herein are noted as using three electrodes, the exemplary embodiment includes gating assemblies with more than three electrodes. It is contemplated that a gating assembly with various stages can be provided, or one with multiple control electrodes, multiple exit electrodes and/or multiple inlet electrodes.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A system for selectively controlling particle flow, the system comprising:

a passage adapted for housing the flow of a gas therethrough, the passage defining an inlet and an outlet;

a particle container;

a branch conduit providing communication between the passage and the particle container, the branch conduit providing communication with the passage at a location between the inlet and the outlet;

a gating assembly defining an aperture and disposed in the branch conduit, the gating assembly including an inlet electrode, an exit electrode, and a control electrode, each electrode adapted to emit an electric field wherein the aperture has an opening span of from about 25 μm to about 75 μm.

2. A method for controlling particle flow from a particle source to a flowing medium in a system comprising (i) a passage adapted for housing a flowing medium, (ii) a particle source, and (iii) a conduit providing communication between the passage and the particle source, wherein as a result of the flowing medium in the passage, particles from the particle source are drawn toward the flowing medium, the method comprising:

providing an electrode assembly of at least three electrodes in the system such that particles flowing from the particle source to the passage, flow past and in close proximity to the electrode assembly; and applying a multi-phase voltage waveform to the electrode assembly to selectively control particle flow from the particle source to the passage.

3. The method of claim 2 wherein the electrode assembly comprises at least a first annular entrance electrode, a control electrode, and a second annular exit electrode disposed between the first electrode and the control electrode, each of the first and second electrodes defining an aperture through which particles in the system can pass.

4. The method of claim 2 wherein for achieving a rapid initial flow of particles past the electrode assembly, an alternating pulsed voltage waveform is applied to two of the three electrodes and a constant voltage is applied to a third electrode, the applied voltages all being opposite in sign to the charge of the particles.

5. The method of claim 2 wherein for achieving a steady flow of particles past the electrode assembly, an alternating pulsed voltage waveform is applied to two of the three electrodes and a zero voltage is applied to a third electrode, the applied voltages all being opposite in sign to the charge of the particles.

6. The method of claim 2 wherein for achieving a rapid termination of particle flow past the electrode assembly, a constant voltage is applied to a third electrode, the voltage being the same in sign as the charge of the particles.

* * * * *